US009127563B2

(12) United States Patent
Dimmick, III et al.

(10) Patent No.: US 9,127,563 B2
(45) Date of Patent: Sep. 8, 2015

(54) LOCKING DEVICE ARRANGEMENT FOR A ROTATING BLADED STAGE

(75) Inventors: John Herbert Dimmick, III, Greenville, SC (US); Andrew Clifford Hart, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 1052 days.

(21) Appl. No.: 13/080,378

(22) Filed: Apr. 5, 2011

(65) Prior Publication Data

US 2012/0257976 A1 Oct. 11, 2012

(51) Int. Cl.

*F01D 5/30* (2006.01)
*F01D 5/02* (2006.01)
*F01D 5/32* (2006.01)

(52) U.S. Cl.

CPC ..... *F01D 5/3038* (2013.01); *F01D 5/027* (2013.01); *F01D 5/32* (2013.01); *Y10T 29/49826* (2015.01)

(58) Field of Classification Search

CPC ..... F01D 5/027; F01D 5/32; F01D 5/3023–5/3026
USPC ..... 416/204 R, 204 A, 215–217
See application file for complete search history.

(56) References Cited

U.S. PATENT DOCUMENTS

| | | | | |
|---|---|---|---|---|
| 3,198,485 | A | 8/1965 | Melenchuk | |
| 3,736,811 | A * | 6/1973 | Neary | 464/180 |
| 3,902,824 | A | 9/1975 | Sauer | |
| 4,477,226 | A | 10/1984 | Carreno | |
| 4,482,296 | A | 11/1984 | Wassell et al. | |
| 4,684,326 | A | 8/1987 | Wassell et al. | |
| 4,781,532 | A | 11/1988 | Novacek et al. | |
| 4,818,182 | A | 4/1989 | Bouru | |
| 5,018,943 | A | 5/1991 | Corsmeier et al. | |
| 5,256,035 | A | 10/1993 | Norris et al. | |
| 5,522,706 | A | 6/1996 | Mannava | |
| 6,332,617 | B1 * | 12/2001 | Leveaux et al. | 277/433 |
| 6,354,780 | B1 | 3/2002 | Davis et al. | |
| 6,582,195 | B2 | 6/2003 | Davidson | |
| 6,619,924 | B2 | 9/2003 | Miller | |
| 6,652,369 | B2 | 11/2003 | Jones et al. | |
| 8,251,667 | B2 * | 8/2012 | Wilson et al. | 416/217 |
| 8,414,268 | B2 * | 4/2013 | Aiello | 416/215 |
| 2002/0015642 | A1 * | 2/2002 | London | 416/215 |
| 2006/0269417 | A1 | 11/2006 | Triconnet et al. | |
| 2008/0282917 | A1 | 11/2008 | Weiler et al. | |
| 2009/0022595 | A1 | 1/2009 | Cosi | |
| 2009/0252611 | A1 | 10/2009 | Tipton et al. | |

(Continued)

FOREIGN PATENT DOCUMENTS

| | | | | |
|---|---|---|---|---|
| EP | 0084491 B1 | 1/1986 | | |
| GB | 2457060 A * | 8/2009 | | F04D 29/32 |
| WO | 2004070169 A1 | 8/2004 | | |

*Primary Examiner* — Nathaniel Wiehe
*Assistant Examiner* — Woody A Lee, Jr.

(57) ABSTRACT

A locking device arrangement for a rotating bladed stage is provided and includes a wheel formed to define a substantially circumferential slot and three slot sections, one of the slot sections including one radial slot and two lock slots to permit blade and blade lock installation along the circumferential slot, respectively, the other slot sections including a lock slot to permit blade lock installation along the circumferential slot, and the three slot sections being separated from one another with angular offsets such that the wheel is mass balanced substantially evenly about a desired center of rotation with the blade locks installed and to reduce accumulation of flowpath gaps.

17 Claims, 3 Drawing Sheets

(56) References Cited

U.S. PATENT DOCUMENTS

| | | | |
|---|---|---|---|
| 2010/0061859 | A1 | 3/2010 | DeMania et al. |
| 2010/0158686 | A1 | 6/2010 | Kim et al. |
| 2010/0196164 | A1 | 8/2010 | Liotta et al. |
| 2010/0284814 | A1 | 11/2010 | Prince et al. |
| 2011/0014053 | A1 | 1/2011 | Eastman et al. |

* cited by examiner

LOCKING DEVICE ARRANGEMENT FOR A ROTATING BLADED STAGE

BACKGROUND OF THE INVENTION

The subject matter disclosed herein relates to a locking device arrangement for a rotating bladed stage.

Rotating bladed stages (i.e., wheels) in gas turbine engines with circumferential dovetail attachments require a radial load slot for blade installation and typically two adjacent radial lock slots for blade locks, one on each side of the load slot. The blade locks prevent blades from working their way back out of the radial load slot.

The radial load slot and the adjacent radial lock slots, however, form a set of three slots that tend to create an inherent unbalance of the rotating mass in the wheel relative to the axis of rotation and a potentially high accumulation of flow path gaps. Indeed, material removed to create the three slots represents a loss of material on one side of the wheel. Since balance correction operations for wheels are usually done with the locking devices installed, the material lost for the lock slots is more than offset by the weight of the adjacent locking devices. The residual unbalance of the slot set with the blade locks installed can still be fairly significant requiring the addition of multiple balance weights for correction.

Furthermore, a significant gap can be produced between blade platforms that cause air leakage (thus reducing the engine performance and efficiency) and aerodynamic disturbances in the flow path. The maximum circumferential gap between blade platforms that can be accumulated is a result of the inherent manufacturing tolerances in the platform widths, the thermal and mechanical radial growth of the wheel and blades, and the number of blades between locker devices.

BRIEF DESCRIPTION OF THE INVENTION

According to one aspect of the invention, a locking device arrangement for a rotating bladed stage is provided and includes a wheel formed to define a substantially circumferential slot and three slot sections, one of the slot sections including one radial slot and two lock slots to permit blade and blade lock installation along the circumferential slot, respectively, the other slot sections including a lock slot to permit blade lock installation along the circumferential slot, and the three slot sections being separated from one another with angular offsets such that the wheel is mass balanced substantially evenly about a desired center of rotation with the blade locks installed and to reduce accumulation of flowpath gaps.

According to another aspect of the invention, a locking device arrangement for a rotating bladed stage is provided and includes a first rotatable body formed to define a first slot and three slot sections, one of the slot sections including a second slot and two third slots in communication with the first slot and the other slot sections including third slots in communication with the first slot, a plurality of second bodies arrayed in the first slot by way of installation via the second slot and a plurality of third bodies respectively disposed within the third slots, the three slot sections being separated from one another with angular offsets such that the first body is mass balanced substantially evenly about a desired center of rotation with the plurality of third bodies disposed within the third slots and to reduce accumulation of flowpath gaps.

According to yet another aspect of the invention, a method of assembling a locking device arrangement for a rotating bladed stage is provided and includes forming a first rotatable body to define a first slot and three slot sections, one of the slot sections including a second slot and two third slots in communication with the first slot and the other slot sections including third slots in communication with the first slot, installing a plurality of second bodies in the first slot via the second slot and installing a plurality of third bodies within each third slot, the forming including separating the three slot sections from one another with angular offsets such that rotation of the first body is mass balanced substantially evenly about a desired center of rotation with the plurality of the third bodies installed within each third slot and to reduce accumulation of flowpath gaps.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 2:
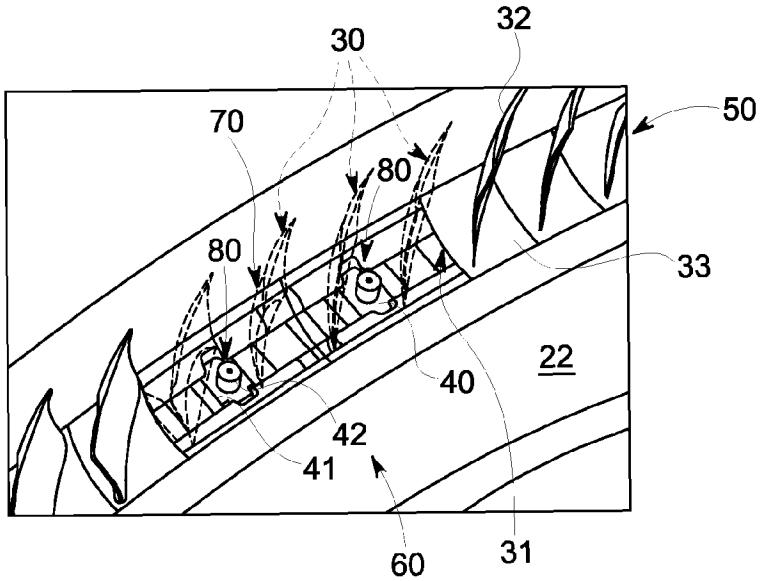
FIG. 2 is an enlarged and partially transparent view of the rotating bladed stage.
Figure 1:
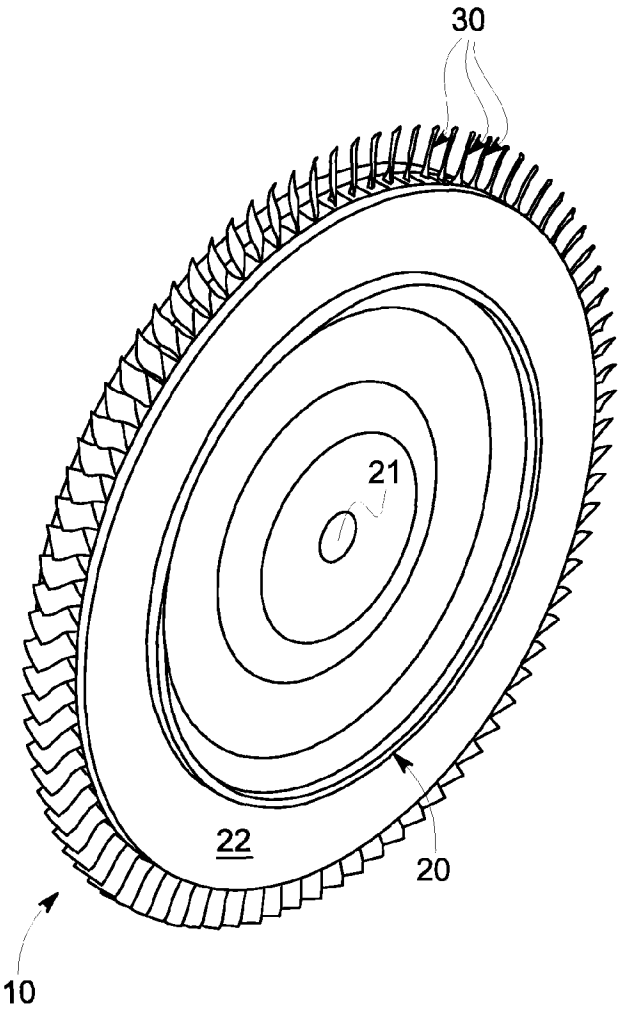
FIG. 1 is a perspective view of a rotating bladed stage.
Figure 3:
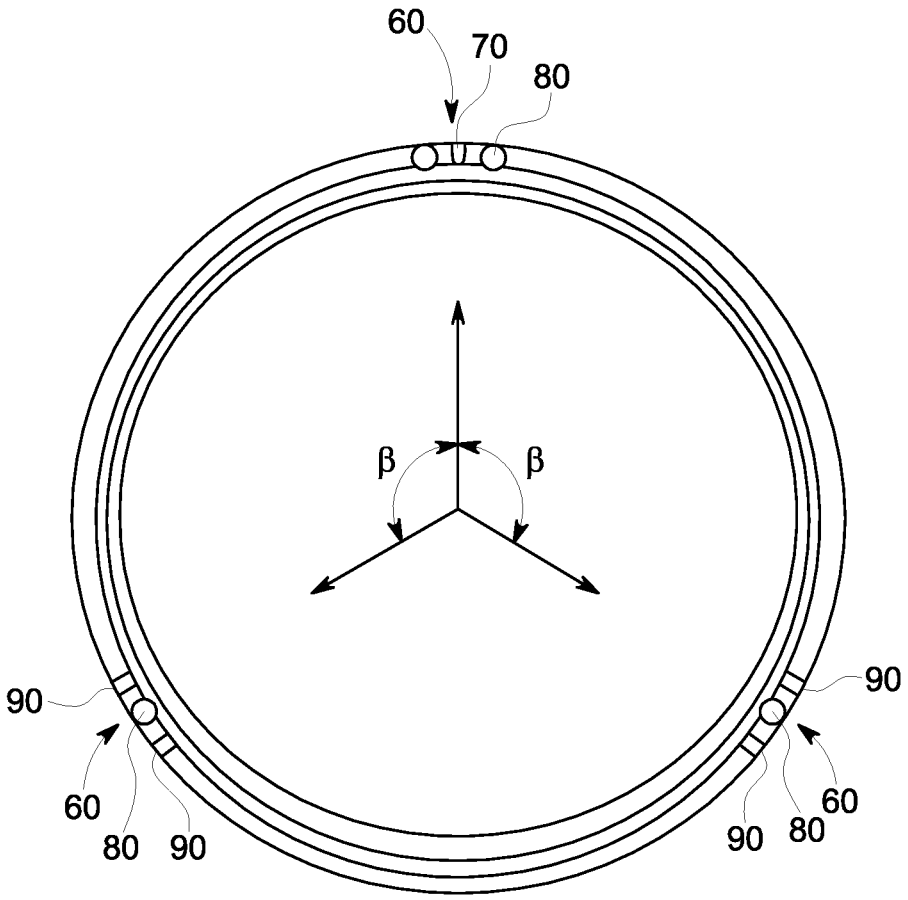
FIG. 3 is an axial view of the rotating bladed stage.

With reference to FIGS. 1-3, a rotating bladed stage 10 of, for example, a turbine engine is provided whereby bladed wheel unbalance and flow path gaps can be reduced.

The rotating bladed stage 10 includes a first rotatable body ("wheel") 20, a plurality of second bodies ("blades") 30 and a plurality of third bodies ("blade locks") 40. The wheel 20 is substantially wheel-shaped and may have a bore 21 defined centrally, although this is not required, and a rim 22 formed at an outer diameter. The rim 22 is further formed to define a first ("substantially circumferential" or "circumferential") slot 50 and three or more slot sections 60. The slot sections 60 are arrayed about the wheel 20 with angular offset separations, β, such that the wheel 20 is mass balanced substantially evenly about a desired center of rotation with blade locks 40 (to be described below) installed and to reduce accumulation of flowpath gaps.

The slot sections 60 may be formed with varying arrangements including that of FIGS. 2 and 3. As shown in FIGS. 2 and 3, one slot section 60 includes at least one second, radial ("blade") slot 70 disposed in communication with the circumferential slot 50 and two or more third, radial ("blade lock") slots 80 also disposed in communication with the circumferential slot 50. The other slot sections 60 each include one or more lock slots 80. Each of the plurality of blades 30 is configured to be arrayed in the circumferential slot 50 and each of the plurality of blade locks 40 is configured to be respectively disposed within corresponding blade lock slots 80. The blade locks 40 serve to limit displacement of at least a portion of the plurality of blades 30 along the circumferential slot 50 and may be arrayed about the wheel 20.

The circumferential slot 50 may have a dovetail-shaped cross-section and extends circumferentially about rim 22 of the wheel 20. Each blade slot 70 and each blade lock slot 80 may be oriented transversely with respect to the circumferential slot 50.

In accordance with embodiments, each blade 30 may include a root 31, a blade section 32 and a platform 33 by which the blade section 32 is coupled to the root 31. The root 31 may have a dovetail shape that facilitates connection of the root 31 to the dovetail shape of the circumferential slot 50 whereby the root 31 may be slidably disposed therein. With the root 31 being slidably disposable in the circumferential slot 50, the respective platforms 33 may abut adjacent platforms 33 and may be sized such that, when the circumferential slot 50 is fully populated with the blades 30, clearance between adjacent platforms 33 permits thermal expansion and contraction of the components discussed herein.

Full population of the circumferential slot 50 occurs when a number of blades 30 are installed therein and an additional individual blade 30 cannot be fit into the remaining space. An amount of this remaining space defines the clearance with an allowance for thermal expansion and contraction.

The blade locks 40 may be arrayed about the wheel 20 with the angular offset separation, β, set to provide a mass balanced wheel 20 and, in addition, serve to limit displacement of at least a portion of the blades 30 along the circumferential slot 50. That is, for any portion of the blades 30 that is bookended by a pair of blade locks 40, individual blades 30 in the portion can be displaced along the circumferential slot 50 by only an arc-length defined in accordance with the sizes of the respective platforms 33, the clearance provided and the arc-length between the corresponding pair of the plurality of blade locks 40. Thus, the individual blades 30 in the portion are prevented from drifting outside the pair of the blade locks 40 thereby reducing accumulation of flowpath gaps.

In accordance with embodiments, each of the blade locks 40 may include a root 41 and a set screw 42, which is insertible in the root 41. The respective roots 41 may each have a dovetail shape that is similar to that of each of the respective roots 31 of the blades 30. The set screw 42 is provided for abuttably preventing blade 30 drift along the circumferential slot 50.

In accordance with further aspects, and with reference to FIGS. 1-3, a method of assembling a rotating bladed stage 10 is provided. The method includes forming a wheel 20 to define a circumferential slot 50 and three or more slot sections 60 arrayed about the wheel 20 with substantially uniform weighting. In accordance with embodiments, one slot section 60 includes a blade slot 70 and two blade lock slots 80 that are all in communication with the circumferential slot 50. The other slot sections 60 each include only a blade lock slot 80 or a blade lock slot 80 and adjacent stress shielding slots 90. The method further includes installing a plurality of blades 30 in the circumferential slot 50 via the blade slot 70 and installing a plurality of blade locks 40 within each of the two or more blade lock slots 80.

The forming may include forming the wheel 20 to define a number of the slot sections 60 in accordance with a desire to provide for substantially uniform circumferential weighting, a number of the blades 30 and cost considerations. The angular offset separations, β, are determined based on the relative mass unbalance imposed on the wheel 20 by each slot section 60.

In accordance with embodiments, the number of slot sections 60 may be 3 or more for both even and odd blade 30 counts. In this way, a similar methodology for the forming operation can be used regardless of blade 30 counts.

In accordance with further embodiments, the angular offset separation, β, is calculated based on the mass of each slot section 60 but will typically be about 125 to about 135 degrees for the example of three slot sections 60.

Once the number of the slot sections 60 is determined, the method includes fully populating the circumferential slot 50 with the plurality of blades 30 with full population being defined as described above and achieved by repeating the installing of the pluralities of blades 30 and blade locks 40. For the example of the definition of three slot sections 60, the full population of the circumferential slot 50 is achieved in accordance with the following exemplary method.

The wheel 20 is rotated as shown in FIG. 3 with the one slot section 60 including the blade slot 70 disposed substantially vertically. At this point, just under a third of the blades 30 are installed in the circumferential slot 50 via the blade slot 70 such that the bottom-most arc-length of the circumferential slot 50 is fully populated. Installation is achieved by radially inserting each blade 30, root 31 first, through the blade slot 70 such that the root 31 radially aligns with the circumferential slot 50 and then sliding the blade 30 along the circumferential slot 50. Blade locks 40 can then be installed in the bottom-most blade lock slots 80 as bookends. Most of the remaining blades 30 are then installed via the top-most blade slot 70 such that each of the lateral arc-lengths of the circumferential slot 50 is fully populated. Blade locks 40 can then be installed in the top-most blade lock slots 80 with potentially a small number of blades 30 between them. The blade locks 40 installed in the top-most blade lock slots 80 prevent the blades 30 from migrating to the blade slot 70 and escaping from the wheel 20.

Figure 4:
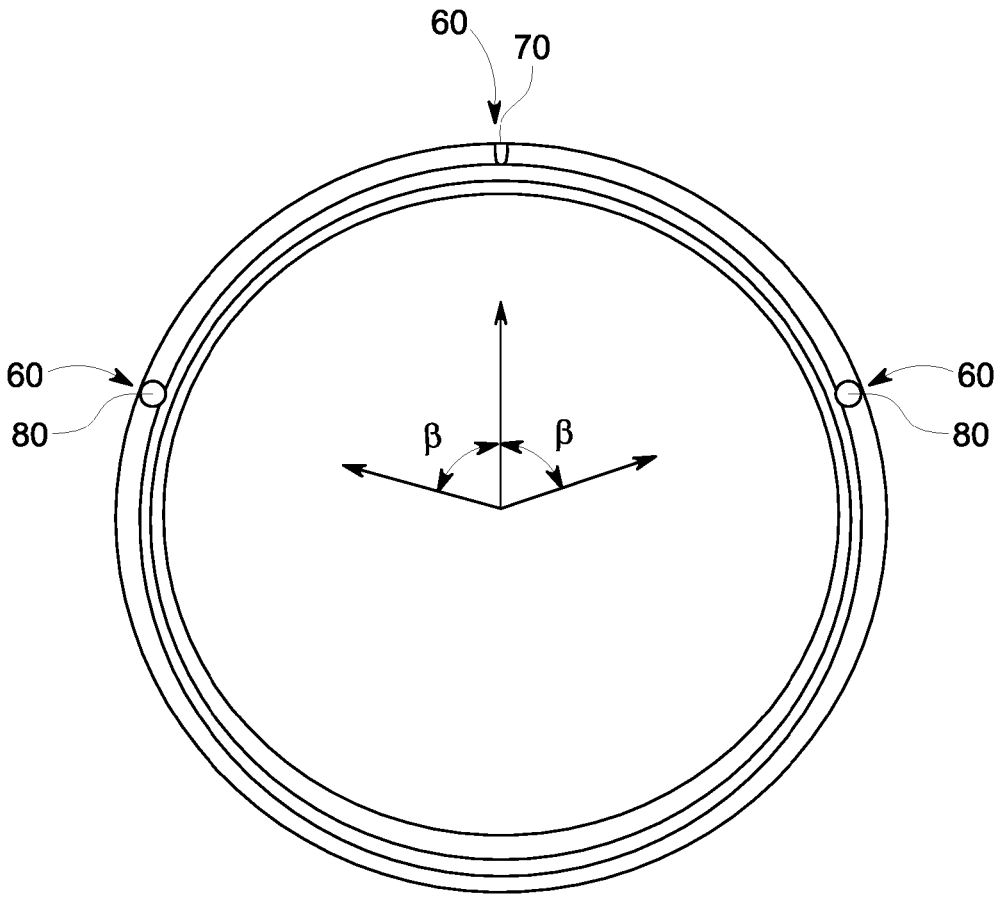
FIG. 4 is an axial view of the rotating bladed stage according to alternate embodiments.

Although one of the slot sections 60 is described above as being defined with a blade slot 70 and two blade lock slots 80, it is to be understood that alternate embodiments exist. For example, with reference to FIG. 4, the vertically disposed slot section 60 may only have a blade slot 70 by which the blades 30 and the blade locks 40 are installed into the circumferential slot 50 while each of the other slot sections 60 includes only a lock slot 80.

In addition, as shown in FIG. 3, the slot sections 60 may also include stress shielding slots 90 adjacent to the lock slots 80 for stress concentration reduction and to reduce the mass of a slot section 60 as needed for additional mass balance and to achieve a more desirable angular offset separation, β, for minimal flowpath gaps.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A locking device arrangement for a rotating bladed stage of a gas turbine engine, comprising:

a rotatable wheel formed to define a first slot and three slot sections, one of the slot sections including a second slot and two third slots in communication with the first slot and the other slot sections including singular third slots in communication with the first slot but lacking second slots;

a plurality of blades arrayed in the first slot by way of installation via the second slot; and a plurality of blade locks respectively disposed within the third slots, the three slot sections being separated from one another with non-uniform angular offsets such that the rotatable wheel is mass balanced substantially evenly about a desired center of rotation with the plurality of blade locks disposed within the third slots and to reduce accumulation of flowpath gaps.

2. The locking device arrangement for the rotating bladed stage according to claim 1, wherein the first slot extends circumferentially about the rotatable wheel.

3. The locking device arrangement for the rotating bladed stage according to claim 2, wherein at least a portion of the second and third slots is oriented transversely with respect to the first slot.

4. The locking device arrangement for the rotating bladed stage according to claim 1, wherein the first slot has a dovetail-shaped cross-section.

5. The locking device arrangement for the rotating bladed stage according to claim 1, wherein the three slot sections are separated from one another with angular offsets such that the rotatable wheel is mass balanced substantially circumferentially evenly about the desired center of rotation with the plurality of blade locks disposed within the third slots.

6. The locking device arrangement for the rotating bladed stage according to claim 1, wherein each of at least a portion of the plurality of blades comprises:

a root;

a blade section; and a platform by which the blade section is coupled to the root.

7. The locking device arrangement for the rotating bladed stage according to claim 6, wherein the root has a dovetail shape.

8. The locking device arrangement for the rotating bladed stage according to claim 6, wherein the root is slidably disposed in the first slot.

9. The locking device arrangement for the rotating bladed stage according to claim 6, wherein the plurality of blades are sized to provide clearance between adjacent platforms in the first slot with the first slot being fully populated.

10. The locking device arrangement for the rotating bladed stage according to claim 1, wherein the plurality of blade locks limits displacement of at least a portion of the plurality of blades.

11. The locking device arrangement for the rotating bladed stage according to claim 1, wherein each of at least a portion of the plurality of blade locks comprises:

a root; and a set screw insertible in the root.

12. The locking device arrangement for the rotating bladed stage according to claim 11, wherein the root has a dovetail shape.

13. The locking device arrangement for the rotating bladed stage according to claim 1, wherein the other slot sections further include fourth slots adjacent to the third slots for additional mass balance and to reduce overall slot stress concentrations.

14. A method of assembling a locking device arrangement for a rotating bladed stage of a gas turbine engine, comprising:

forming a rotatable wheel to define a first slot and three slot sections, one of the slot sections including a second slot and two third slots in communication with the first slot and the other slot sections including singular third slots in communication with the first slot but lacking second slots;

installing a plurality of blades in the first slot via the second slot; and installing a plurality of blade locks within each third slot, the forming comprising separating the three slot sections from one another with non-uniform angular offsets such that rotation of the rotatable wheel is mass balanced substantially evenly about a desired center of rotation with the plurality of the blade locks installed within each third slot and to reduce accumulation of flowpath gaps.

15. The method according to claim 14, wherein the forming comprises forming the rotatable wheel to define a number of slot sections in accordance with at least a number of the plurality of blades.

16. The method according to claim 14, further comprising fully populating the first slot with the plurality of blades.

17. The method according to claim 16, wherein the fully populating comprises repeating the installing of the pluralities of blades and blade locks, respectively.

* * * * *